United States Patent [19]

Lundström

[11] Patent Number: 4,599,849

[45] Date of Patent: Jul. 15, 1986

[54] METHOD AND A MACHINE FOR PACKING SLICED PRODUCTS IN A CONTAINER TO BE VACUUM SEALED

[75] Inventor: René Lundström, Staffanstorp, Sweden

[73] Assignee: Svenska AB Ivers Lee, Lund, Sweden

[21] Appl. No.: 624,744

[22] PCT Filed: Nov. 2, 1983

[86] PCT No.: PCT/SE83/00377

§ 371 Date: Jun. 29, 1984

§ 102(e) Date: Jun. 29, 1984

[87] PCT Pub. No.: WO84/01762

PCT Pub. Date: May 10, 1984

[30] Foreign Application Priority Data

Nov. 2, 1982 [SE] Sweden ..... 8206224

[51] Int. Cl.[4] ..... B65B 5/10; B65B 25/06

[52] U.S. Cl. ..... 53/427; 53/116; 53/429; 53/509; 53/536; 53/DIG. 1

[58] Field of Search ..... 53/427, 429, DIG. 1, 53/509, 517, 116, 536; 426/129, 121, 396, 502, 392, 394, 397, 404, 416

[56] References Cited

U.S. PATENT DOCUMENTS

| | | | |
|---|---|---|---|
| 2,521,577 | 9/1950 | Gannon | 53/DIG. 1 |
| 2,980,541 | 4/1961 | MacDonald | 53/DIG. 1 |
| 3,475,184 | 10/1969 | La Mers et al. | 53/DIG. 1 |
| 3,671,271 | 6/1972 | Miller | 426/121 |
| 4,106,260 | 8/1978 | King | 53/117 X |
| 4,513,559 | 4/1985 | Herrington, Jr. | 53/117 |

FOREIGN PATENT DOCUMENTS

| | | |
|---|---|---|
| 357176 | 11/1970 | Sweden . |
| 1119744 | 7/1968 | United Kingdom . |

*Primary Examiner*—James F. Coan
*Attorney, Agent, or Firm*—Ladas & Parry

[57] ABSTRACT

Method and machine for packing bacon bundles in blister packages. Bacon bundles (2) are placed in the blister package (15) by a lifting arm (17) having rotatable rods (21) and transversally extending tines (22). The rods (21) are rotatable over 90°. The distance between the outer tines is slightly smaller than the length of the blister package. If the bacon bundle is too long it will depend over the outer tine and the depending portion (24) will automatically be double folded at the positioning of the bacon bundle in the blister package.

8 Claims, 1 Drawing Figure

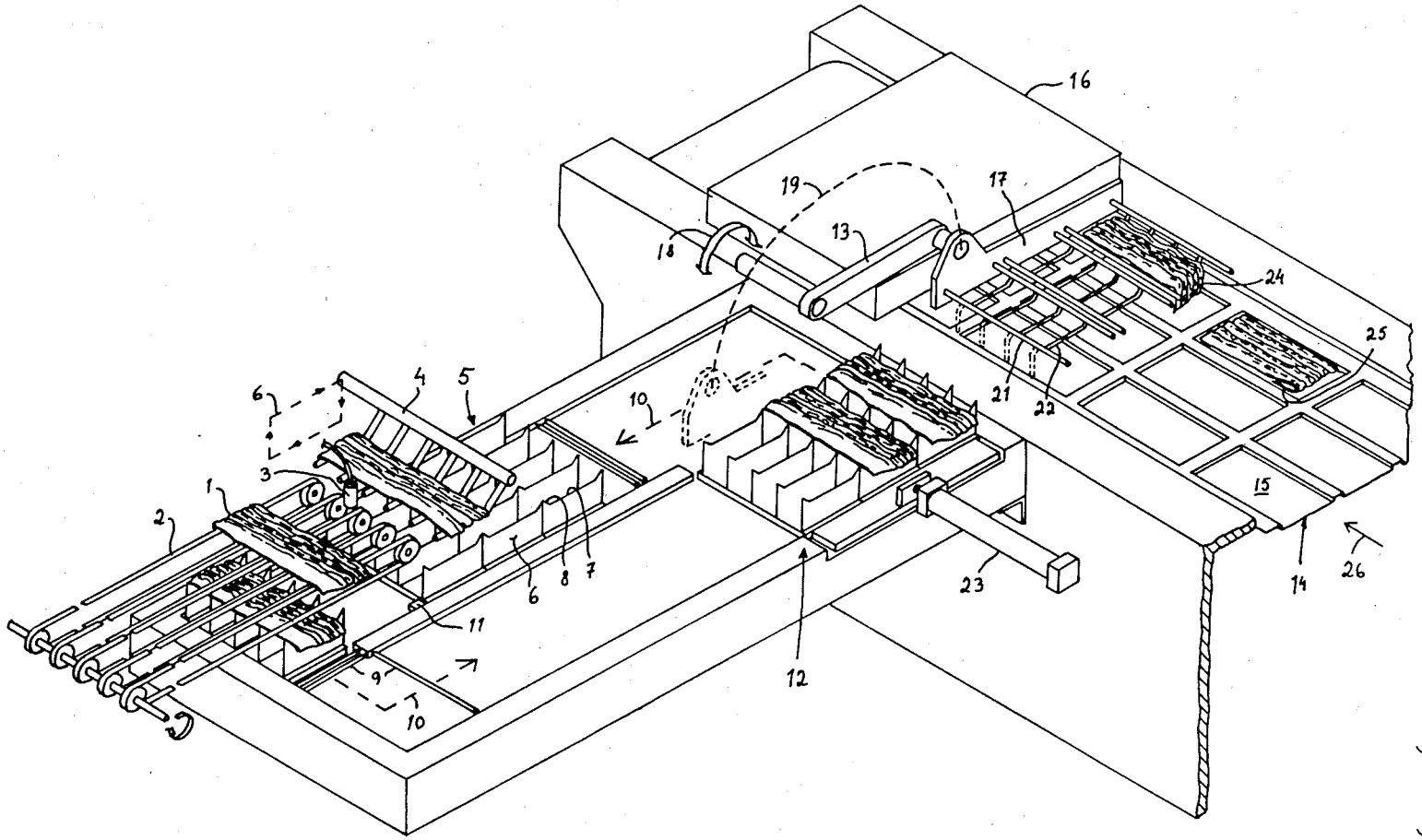
1
2
3
4
5
6
7
8
9
10
11
12
13
14
15
16
17
18
19
21
22
23
24
25
26

METHOD AND A MACHINE FOR PACKING SLICED PRODUCTS IN A CONTAINER TO BE VACUUM SEALED

The present invention relates to a packing machine for packing sliced products such as bacon in a blister package or similar.

The packing machine comprises a lifting device for lifting the sliced bacon bundles fed to the machine. The lifting device comprises two lifting rods extending from a lifting arm. Each lifting rod has several tines which cooperate to support a bacon bundle. The lifting rods are rotatable so as to place the tines in a vertical position, in which they can be introduced below the bacon bundle, and a horizontal position, in which they support the bacon bundle.

A machine which has a small resemblance with the above-mentioned machine is disclosed in the U.S. Pat. No. 3,021,656, which relates to a device for use in filling a container with fruit. Said machine includes interdigiting tines which support the fruit before introducing them in a container.

In the machine according to the invention the bacon bundles are positioned in a blister package which thence are sealed with a vacuum packaging technique well-known in the art.

However, in order to achive a reliable and positive seal of the blister package, it is required that the sealing area is prevented from being contaminated by the grease from the bacon bundle. In several bundles, each bacon slice is a little bit longer than the blister package, which often results in the fact that the sealing area is greased. Thus, it is necessary to arrange for a means which prevents said contamination of the sealing area of the blister package.

It is an object of the present invention to provide a machine for packing bacon bundles or similar in a blister package, in which a too long bacon slice will not grease the sealing area of the blister package.

Another object of the invention is to provide a method of packing a bacon bundle in a blister package, in which the sealing area is prevented from being greasy.

According to the invention there is provided a method of packing a bacon bundle or similar in a blister package to be vacuum sealed, comprising the steps of lifting each bacon bundle by several horizontal and transversally extending tines; bringing at least one rim portion of the bacon bundle to depend if the length of the bacon bundle exceeds the length of the blister package; introducing the bacon bundle in the blister package, the depending portion being folded below the remaining bundle; and vacuum sealing the blister package.

In accordance with the invention there is also provided a machine for packing bacon bundles or similar in a blister package to be vacuum sealed, said machine comprising a lifting arm having at least two lifting rods extending laterally from the lifting arm and being provided with several transversally extending tines, the lifting rods being rotatable in order to place said tines in a horizontal and a vertically depending position. The distance between the outer tines of each lifting rod is slightly smaller than the maximally allowed length of each bacon bundle, whereby the bacon bundle if too long depends over the outer tine in order to be double folded at the position of the bacon bundle in the blister package.

A preferred embodiment of the invention is described in more details below by reference to the appended drawings, in which the only FIGURE is a partially schematic and partially broken perspective view of a machine according to the invention.

The machine comprises an infeed portion having transport belts 2 for feeding a bundle 1 of sliced bacon from a slicer. A sensor 3 monitors the arrival of a bacon bundle and a lifting arm 4 is activated in order to lift the bacon bundle 1 from the belts 2 to a transport pallet 5 positioned immediately beyond the belts 2. The lifting arm 4 is moved along a lifting path 6 be means not shown. The pallet 5 is adapted to the size of the bacon bundle which is supported by several walls 6 of the pallet. Each wall 6 has a plane portion 7 which supports the bacon bundle and two projecting corners 8. The pallets 5 are transported in a circular manner shown by arrows 10 by means of driven rolls 9 forming a roll path. Only a few rolls are shown on the drawing while the whole area in which the pallets are moving is covered with rolls 9.

The pallets are stopped in the position below the lifting arm 4 by a stop device 11, which is retracted when a bacon bundle has been placed on the pallet, and the pallet is moved in the direction of arrow 10 to the outfeed position 12.

A lifting device 13 is adapted to lift the bacon bundle 1 from each pallet 5 and place the bundle in empty packages 15. The empty packages are formed by a sheet 14 which is moulded to the shape shown in the FIGURE. The sheet 14 is moved to the left in the FIGURE as shown by arrow 26.

The sheet 14 comprises three empty packages 15 in a row, but another number of packages in each row is conceivable. The packages 15 are preferably blister packages in which the bacon bundles are packed by a vacuum sealing technique below the cover 16 in accordance with known technique.

The lifting device 13 comprises a lifting arm 17 which is always horizontal. The rotatable arm 13 is rotated along the arc 19 from the position shown in broken lines, in which the bacon bundles are fetched, to a delivery position shown in solid lines immediately above the blister packages 15. The lifting arm 17 comprises three pairs of horizontal extending rotatable rods 21, each having four tines 22. The rods 21 are rotatable over 90° between the two positions shown in solid and broken lines for the leftmost rod 21 of the FIGURE.

The machine according to the invention operates as follows. The sensor 3 monitors a bacon bundle and activates the lifting arm 4 in order to place the bacon bundle on the pallet 5 below. The pallet 5 is fed to the outfeed position 12 by the retraction of the stop means 11 and rotation of the rolls 9. When three pallets are gathered at the outfeed position 12, the lifting device 13 is activated and moves from the position shown in solid lines to the position shown in broken lines, having the tines extending vertically downwards. The tines pass beside and below each bacon bundle whereupon they are rotated to the horizontal position below each bacon bundle in order to support each bundle. Thence, the lifting device 13 is rotated to the position shown in solid lines, thus transferring three bundles of bacon. In the FIGURE only the right-most tines are shown provided with a bundle of bacon.

The distance between the outer tines 22 of each rotatable rod 21 is slightly smaller than the length of the blister package. Thus, one or both of the rims of the bacon bundle will depend as shown in the FIGURE at 24, if the length of the bundle is too long.

Finally, the rods 21 are slowly rotated to the position shown in broken lines in the FIGURE, thus placing the bacon bundle in the blister package. The depending portion 24 will automatically be double folded as shown at 25 (shown at the wrong side of the lifting arm 17 while the feeding direction of the blister packages are to the left as shown by arrow 26). The tines 22 will cooperate with the longitudinal rim of the blister package and prevent said rim from being greasy.

After said operation a cylinder 23 is activated and pushes the empty pallets to the left side of the roll path whereupon the cycle is repeated.

From the above description it is evident that the bacon bundle will not make the sealing portions of the package greasy and the vacuum sealing machine below the cover 16 can operate satisfactorily. The machine according to the invention can handle all kinds of sliced products, such as ham, sausage, etc.

The machine can be modified in many respects within the scope of the invention and such modifications obvious to a skilled person are intended to be within the scope of the invention. The invention is only limited by the appended claims.

I claim:

1. A method of packing sliced products such as bacon bundles in a blister package or similar to be vacuum sealed, characterized in lifting each bacon bundle by several horizontal, transversally extending tines;

bringing at least one rim portion of the bacon bundle to depend if the length of the bacon bundle exceeds the length of the blister package;

introducing the bacon bundle in the blister package, the depending portion being folded below the remainder of the bundle; and vacuum sealing the blister package.

2. A method as claimed in claim 1, characterized in pivoting the tines from a horizontal position, supporting the bacon bundle, to a vertical position, in which the bacon bundle is placed in the blister package.

3. A machine for packing sliced products, such as bacon bundles, in a blister package or the like to be vacuum sealed, said machine comprising a lifting arm (17) having at least two lifting rods (21) extending laterally from the lifting arm (17) and being provided with several transversally extending tines (22), the lifting rods being rotatable in order to place said tines in a horizontal position and a vertically depending position, characterized in that the distance between the outer tines of each lifting rod is slightly smaller than the maximally allowed length of each bacon bundle, whereby the bacon bundle if too long depends over the outer tine in order to be double folded when the bacon bundle is in position in the blister package.

4. A machine as claimed in claim 3, characterized in that the tines in the vertically depending position are adapted to cooperate with the longitudinal rim of the blister package in order to prevent said rim from being contaminated by grease.

5. A machine for packing sliced products, such as bacon bundles, in a blister package or the like to be vacuum sealed, said machine comprising a lifting arm (17) having at least two lifting rods (21) extending laterally from the lifting arm (17) and being provided with several transversally extending tines (22), the lifting rods being rotatable in order to place said tines in a horizontal and a vertically depending position, characterized in that the distance between the outer tines of each lifting rod is slightly smaller than the maximally allowed length of each bacon bundle, whereby the bacon bundle if too long depends over the outer tine in order to be double folded at the position of the bacon bundle in the blister package, and further characterized by pallets (5) to which each bacon bundle is transferred, and an outfeed station (12) in which preferably three pallets are gathered before loading a row of blister packages.

6. A machine as claimed in claim 5, characterized in that the blister packages are moulded from a sheet (14) and comprises several rows with preferably three packages in each row whereby all packages in each row is loaded at one time.

7. A machine as claimed in claim 6, characterized in that the tines in the vertically depending position are adapted to cooperate with the longitudinal rim of the blister package in order to prevent said rim from being contaminated by grease.

8. A machine as claimed in claim 5, characterized in that the tines in the vertically depending position are adapted to cooperate with the longitudinal rim of the blister package in order to prevent said rim from being contaminated by grease.

* * * * *